US007389611B2

(12) United States Patent
Palenske CI

(10) Patent No.: US 7,389,611 B2
(45) Date of Patent: Jun. 24, 2008

(54) ADJUSTABLE THRESHOLD

(75) Inventor: Grant A. Palenske CI, Laguna Hills, CA (US)

(73) Assignee: Columbia Aluminum Products, LLC, City of Commerce, CA (US)

( * ) Notice: Subject to any disclaimer, the term of this patent is extended or adjusted under 35 U.S.C. 154(b) by 594 days.

(21) Appl. No.: 10/938,290

(22) Filed: Sep. 10, 2004

(65) Prior Publication Data

US 2006/0053707 A1 Mar. 16, 2006

(51) Int. Cl.
*E06B 1/70* (2006.01)

(52) U.S. Cl. ..... 49/468; 49/469

(58) Field of Classification Search ..... 49/467, 49/468, 469; 52/204.1, 126.7
See application file for complete search history.

(56) References Cited

U.S. PATENT DOCUMENTS

| | | | | | |
|---|---|---|---|---|---|
| 3,402,512 | A | | 9/1968 | Peterson | 49/468 |
| 3,762,100 | A | * | 10/1973 | Kempel | 49/468 |
| 3,900,967 | A | | 8/1975 | Bursk et al. | 49/468 |
| 4,352,258 | A | | 10/1982 | Bursk et al. | 49/468 |
| 5,010,690 | A | * | 4/1991 | Geoffrey | 49/468 |
| 5,136,814 | A | * | 8/1992 | Headrick | 49/468 |
| 5,230,181 | A | | 7/1993 | Geoffrey et al. | 49/469 |
| 5,426,894 | A | | 6/1995 | Headrick | 49/468 |
| 5,517,788 | A | | 5/1996 | McGough et al. | 49/468 |
| 5,588,266 | A | | 12/1996 | Headrick | 52/204.1 |
| 5,611,173 | A | | 3/1997 | Headrick et al. | 49/468 |
| 6,185,870 | B1 | | 2/2001 | Mettler | 49/468 |
| 6,345,477 | B1 | | 2/2002 | Kepler et al. | 52/204.1 |
| 6,367,201 | B1 | * | 4/2002 | Massey et al. | 49/467 |
| 6,484,446 | B2 | | 11/2002 | Young | 49/469 |
| D474,844 | S | | 5/2003 | Babka et al. | D25/48 |
| 6,789,358 | B2 | * | 9/2004 | Procton et al. | 49/471 |
| 2002/0129557 | A1 | | 9/2002 | Young | 49/468 |
| 2004/0139667 | A1 | * | 7/2004 | Massey et al. | 52/204.1 |
| 2005/0210754 | A1 | * | 9/2005 | Ferrell | 49/468 |

FOREIGN PATENT DOCUMENTS

| | | |
|---|---|---|
| EP | 0 430 586 A1 | 11/1990 |

* cited by examiner

*Primary Examiner*—Jerry Redman
(74) *Attorney, Agent, or Firm*—Cislo & Thomas, LLP

(57) ABSTRACT

An adjustable threshold has a lip portion with an adjustable vinyl insert to prevent material from becoming trapped or from engaging a seam present between a floor and a frame member portion adjacent to the floor. The adjustable threshold engages an H-rail trapped in the main U-shaped channel of the frame member which in turn covers and is generally supported by a substrate block. In a preferred embodiment, a first and generally front wall of the frame member is engaged only on one side by a threshold cap. The lip serves to help entrap a second descending wall of the threshold cap and to keep it in place to provide support and stability for the threshold cap. Alternative embodiments exist wherein a lip is advantageously present in a variety of embodiments.

23 Claims, 3 Drawing Sheets

ADJUSTABLE THRESHOLD

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to doorsill assemblies and, in particular, to adjustable thresholds for use in such doorsill assemblies.

2. Description of the Related Art

Over the years, a wide variety of doorsill assemblies have been made with adjustable thresholds. Door sill assemblies were initially designed to fit immediately below an entryway door but are now often extended to adjacent side lights to provide a continuous sill having a uniform, aesthetic appearance while forming a water tight juncture between the sill and the adjoining building floor surface. Such doorsill assemblies also prevent the door from swinging too far forward in the frame so that the hinges are not damaged.

Adjustable sills were developed to provide a threshold which an installer can adjust to fit a specific door. By maintaining a predetermined clearance between the threshold and the door, a door seal can effectively keep out wind and water. Being closest to the ground, the threshold and its juncture with the door is the first line of contact between outside water and cold air and the environment inside the door.

It is desirable that adjustable thresholds be easy to install and adjust, structurally sound, relatively inexpensive and aesthetically pleasing. Another important feature in cold climates is that the threshold should provide a good thermal barrier in order to prevent condensation and icing on the portion of the threshold within the building interior.

With the advent of adjustable sills, it was no longer as necessary to ensure that the measurements of the door, its fit in the frame, or otherwise were exact as the adjustable threshold could be used to provide the seal between the threshold and the door. As a result, construction could be faster, quicker, and even better as the threshold could be adjusted for the best position after the door and threshold had been installed.

SUMMARY OF THE INVENTION

The present invention provides a new construction for an adjustable threshold wherein the same can be used to provide an adjustable threshold for a door construction and the like.

The general purpose of the present invention, which will be described subsequently in greater detail, is to provide a new adjustable threshold which has many of the advantages of prior adjustable thresholds as well as many novel features that results in a new adjustable threshold that is not anticipated, rendered obvious, suggested, taught, or even implied by any prior art adjustable thresholds, either alone or taken in any reasonable combination thereof.

In providing manufacturing efficiencies as well as advantages in construction, the adjustable threshold set forth herein has a frame member with a sloped sill resting upon a substrate block. An H-rail or the like is disposed between two abutting elements of the frame member. The two abutting elements slidably engage the H-rail.

Alignment and support walls or members then engage a threshold cap on the interior thereof to keep the threshold cap in place with respect to the frame member. The threshold cap rides up and down generally vertically with respect to the frame member according to adjustment screws threadably inserted into the H-rail. Plugs in the threshold cap allow access to the adjustment screws. A lip of the frame member is present on the inside, or door side, of the adjustable threshold and may engage a vinyl insert of a selectably adjustable size.

The lip helps the adjustable composite tile sill, or the adjustable threshold, to have a unique feature which may be denominated a "tile lip." This feature allows floor covering material such as ceramic tile, vinyl, wood or carpet, among other materials, to be installed under the sill and to eliminate gaps between the entryway. This also benefits the flooring installers and homeowner as no additional work is necessary to install the flooring material. The feature leaves a seamless finish which is very attractive. The inside tile lip is designed to fit the most common tile size ⅝" and can be adjusted from ⅛" high flooring material to ⅝" with different seal inserts.

In one embodiment of the adjustable threshold set forth herein, an adjustable threshold for use in conjunction with a doorway has a frame member having a main U-shaped channel as well as a vertically-adjustable rail slidably fitting within the main U-shaped channel. A lip is coupled to the main U-shaped channel with a threshold cap engaging the main U-shaped channel and the lip so that adjustment of the vertically adjustable rail adjusts height of the threshold cap.

In another embodiment of the adjustable threshold set forth herein, an adjustable threshold for use in conjunction with a doorway has a substrate block and a frame member covering at least a portion of the substrate block. The frame member has a main U-shaped channel and a sloped sill portion having at least one rib. The rib may be an upwardly extending rib for improved traction and/or a downwardly extending support rib. A shelf coupled to the sloped sill portion may provide a front support for the frame member. The frame member may have a first wall coupled to the sloped sill portion to provide a first side of the main U-shaped channel. A bottom may be coupled to the first wall and provide a bottom to the main U-shaped channel. The bottom may define an adjustment member channel for receiving an adjustment member such as a threaded bolt or screw. A second wall coupled to the bottom may provide a second side of the main U-shaped channel.

The U-shaped channel may have a first abutment member coupled to the first wall, as well as a second abutment member coupled to the second wall, with the first and second abutment members abutting opposite sides of the vertically adjustable rail. The first abutment member may have a first inwardly projecting strip support coupled to a T-shaped head with an upper projection of the T-shaped head projecting away from the vertically adjustable rail. The second abutment member may have a second inwardly projecting strip support similar to the first inwardly projecting strip support coupled to an upwardly-extending projection having a distal end thereof projecting away from the vertically adjustable rail such that the vertically adjustable rail is slidably entrapped between the first and second abutment members.

A vertically adjustable H-shaped rail may slidably fit within the main U-shaped channel. The H-shaped rail may have a left side wall, a right side wall, and a cross member coupled on one side to the left side wall and on another side to the right side wall, the cross member defining a threaded aperture for receiving a threaded adjustment member. The threaded adjustment member may be selected from the group consisting of screws and bolts. The left side wall may have an upward projection terminating in an outward projection for engaging the threshold cap while the right side wall may have an upward projection terminating in an outward projection for engaging the threshold cap.

A lip may be coupled to the main U-shaped channel. The threshold cap may engage the main U-shaped channel and the lip such that adjustment of the vertically adjustable rail adjusts height of the threshold cap. The threshold cap may have a left descending wall, a top coupled to the left descending wall, and a right descending wall coupled to the top with the left descending wall engaging the frame member and the lip and the right descending wall engaging the an external side of the U-shaped channel. The top may define an aperture for receiving a plug.

In an alternative embodiment, the H-shaped rail may be omitted with the U-shaped channel provided a threaded aperture for the adjustment screw or bolt. The threshold cap slidably engages the head of the adjustment screw or bolt which then serves to both support and position the threshold cap with respect to the adjustable threshold as a whole.

DESCRIPTION OF THE PREFERRED EMBODIMENT(S)

Figure 1:
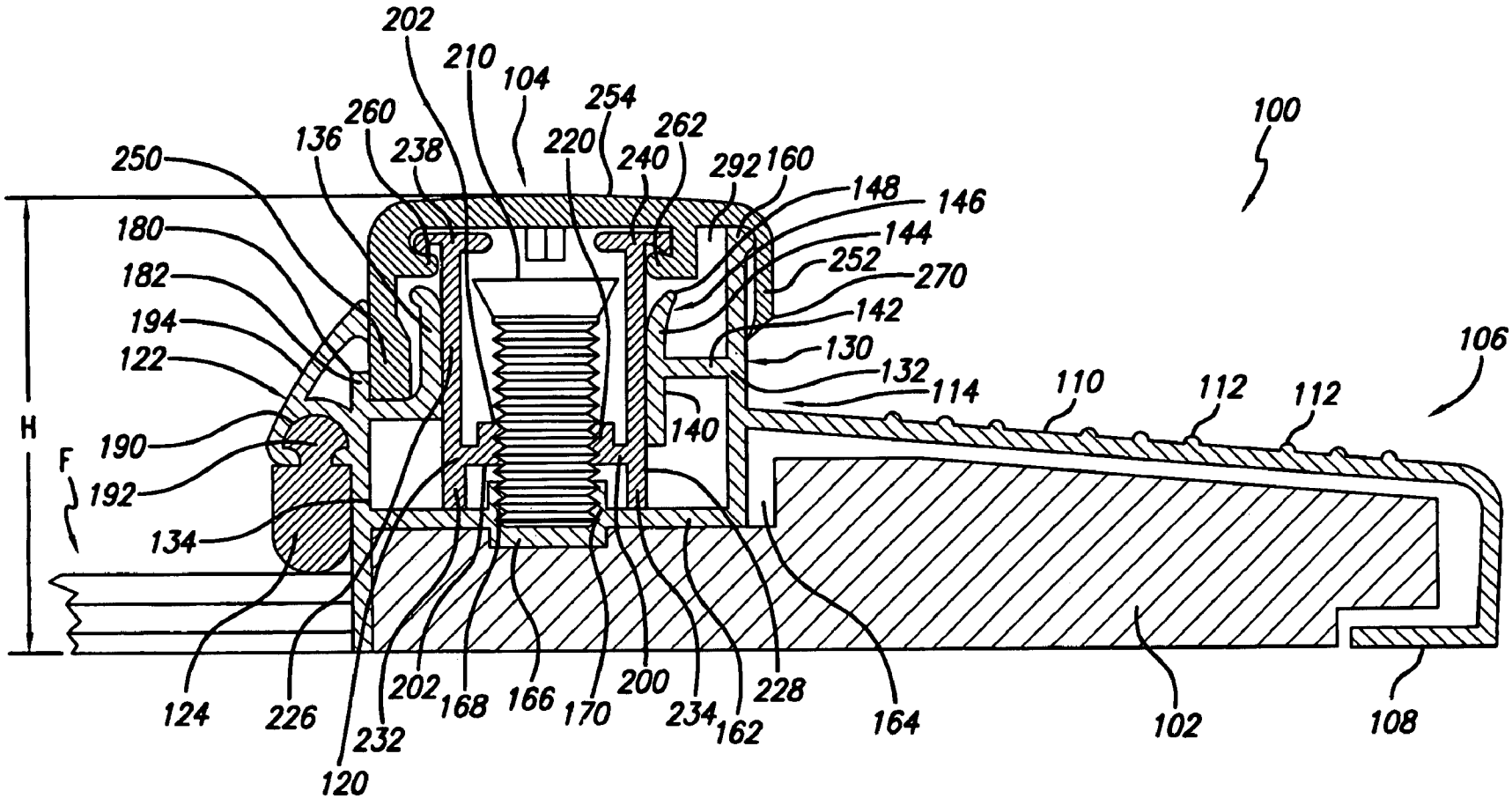
FIG. 1 is a side cross-sectional view of a first embodiment of the adjustable threshold set forth herein.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings, where like numerals of reference designate like elements throughout it will be noted that the adjustable threshold 100 has generally a height H measured from the bottom of the substrate block 102 to the top of the threshold cap 104. The height H may also be generally measured from the bottom of the floor F which is generally or often at the same relative height as the bottom of the substrate block 102.

Save for its engagement with the ground beneath, the substrate block 102 is generally circumscribed by the frame member 106 in the embodiment shown in FIG. 1. The frame member 106 has a shelf 108 that undercuts the right most end of the substrate block 102.

The shelf 108 initiates a first end of the frame member 106 which subsequently rises vertically in front of a substrate block 102 then travels upwardly at an angle along a sloped sill portion 110 which may or may not have ribs 112 traveling along its span. The slope sill 110 of the frame member 106 leads into the main threshold portion 114 of the frame member 106. The main threshold portion 114 is described in more detail below.

The main threshold portion 114 is also supported by the substrate block 102 and serves to provide support and stability for the H-rail 120. The H-rail 120 is an embodiment of an adjustment member (or a portion thereof) and may be selectably disposable vertically with respect to the frame member 106 and the main threshold portion 114.

The main threshold portion 114 is coupled to a lip 122 to which a vinyl insert 124 may be selectably attached.

The lip 122 helps the adjustable composite tile sill, or the adjustable threshold 100, to have a unique feature which may be denominated a "tile lip." This feature allows floor covering material such as ceramic tile, vinyl, wood or carpet, among other materials, to be installed under the sill and to eliminate gaps between the entryway. This also benefits the flooring installers and homeowner as no additional work is necessary to install the flooring material. The feature leaves a seamless finish which is very attractive. The inside tile lip is designed to fit the most common tile size ⅝" and can be adjusted from ⅛" high flooring material to ⅝" with different seal inserts.

The adjustable threshold 100 is coupled to and/or forms a part of a door sill or other similar system as is known in the art or developed in the future.

The main threshold portion 114 of the frame member 106 has a main U-shaped channel 130 having a first wall 132 coupled to the sloped sill portion 110 and a second wall portion 134 coupled to the lip 122 and generally adjacent to vinyl insert 124. The second wall 134 has an inward projection 136 which serves to both abut the H-rail 120 as well as engage the threshold cap 104 in conjunction with the lip 122. Projecting inwardly from the first wall 132, the main threshold portion 114 has a first, or right side, abutting member 140. The abutting member, like most of the structures in the adjustable threshold 100, extends laterally (from the viewpoint of FIG. 1, into and/or out of the page) generally to the extent and span necessary in order to achieve the goals and purposes of the adjustable threshold system set forth herein. The first abutting member 140 is generally T-shaped in cross-section as indicated in FIG. 1.

The strip 142 supporting the head 144 of the first abutting member 140 projects the head 144 into the interior of the main threshold portion 114 to the extent necessary to properly engage or otherwise enable the H-rail 120 in its capacity to provide vertical adjustment. As shown in FIG. 1, the upper end 146 of the head 144 is curved slightly outwardly and away from the H-rail 120. The slight curvature enables better insertion of the H-rail 120 into the main threshold portion 114.

This insertion is complemented by an outwardly extending projection 148 present at the distal end of the inward projection/second abutting member 136 of the second wall 134 of the main U-shaped channel 130 of the main threshold portion 114.

The H-rail 120 is generally held slidably but fixedly and is externally abutted by the first abutting member 140 and the second abutting member 136. From the perspective shown in FIG. 1, the degree of freedom of the H-rail 120 to travel either left or right is eliminated by the first and second abutting members 140, 136. However, the H-rail 120 is free to travel vertically upward and out from the H-rail channel defined between the two abutting members 140, 136. Similarly, the H-rail may travel laterally between the two abutting members 140, 136. From the viewpoint of FIG. 1, this lateral travel of the H-rail 120 between the two abutting members 140, 136 would be into or out of the plane of the page.

The first wall 132 of the main channel 130 may extend upwardly and terminate in a small knob bead or seam 160 that may extend slightly outwardly from the interior of the main channel 130. The first wall 132 may descend to the substrate block 132. The bottom 162 of the main channel 130 may travel along the substrate block 102 in a notched portion 164 thereof. The bottom 162 may define an adjustment screw channel 166 generally central within the bottom 162. As for most, if not all, of the structures shown in FIG. 1, the cross-sectional view is meant to portray a cross section of structures that generally extend into and out of the page for the span necessary in order to achieve the present system.

The adjustment screw channel 166 may descend slightly below the general plane of the bottom 162 with side walls 168, 170 descending upwardly slightly to restrain an adjustment screw 210 within the confines of the adjustment screw channel 166. The ascent of the side walls 168, 170 is generally limited so that they do not contact the H-rail 120 when the H-rail 120 is in its lower-most position within the main threshold portion 114. The bottom 162 of the main threshold portion 114 and the main U-shaped channel 130 connects to the second wall 134 which, as shown in FIG. 1. As shown in FIG. 1, the second wall 134 descends to the bottom of the substrate block 102 and generally divides the substrate block 102 from the floor F. The top 180 of the second wall generally rises to a height the same or similar as the strip support 142 of the first or right side abutting member 140.

Slightly below the top 180 of the second wall 134, the inward projection 136 may begin its inward travel towards the interior of the main U-shaped channel 130 leaving a slight stub or post 182 present. The lip 122 may connect to the second wall 134 slightly below and on the opposite side of the connection of the inward projection 136 with the second wall 134.

The lip may define an open inlet 190 capable of restrictedly receiving a vinyl insert 124. The open inlet may be generally C-shaped in cross-section as shown in FIG. 1 in order to entrappingly engage a top projection 192 of the vinyl insert 124. The lip 124 may also have an upward and inward projection 194 that projects upwardly and inwardly at an angle from a distal side of the open inlet 190, the distal side being the side unattached and away from the second wall 134. The lip's upwards and inward projection 194 may terminate generally above the stub 182 of the second wall 134 generally having a flat face surface on a side opposite that of the inward projection/second abutting member 136. The lip's upwards and inward projection 194 may terminate at a height generally slightly below that of the height of the inward projection 136.

The H-rail 120 may have a cross-member or web 200 that generally travels the span or length of the H-rail 120. Generally spaced at regular intervals, threaded apertures 202 punctuate and perforate the cross member 200 in order to provide threaded engagement for the adjustment screw 210 or other adjustment member. The threaded aperture 202 may have a side support wall 220 extending upwardly from the threaded aperture 202 and circumscribing same. The side support wall 220 may also be threaded as is the aperture 202 in order to provide support and threaded engagement for the adjustment screw or bolt 210. Upwardly extending side walls 226, 228 are attached to the cross member 200 at a height that generally prevents the left and right side walls 168, 170 of the adjustment screw channel 166 from contacting the bottom of the cross member 200.

However, in an alternative embodiment, such contact may serve to define the bottom or lower most extent or descent of the H-rail 120 into the main threshold portion 114. The bottom most portion or legs 232, 234 of the left and right side walls 226, 228 generally rest against and engage the bottom 162 of the main U-shaped channel 130 when the H-rail 120 is in its lower-most position within the main channel 130. The left and right side walls 168, 170 extend upwardly and terminate in T-shaped cross sections 238, 240. The external arms of these T-shaped portions may have beads or seams similar to that of the bead or seam 160 so as to provide easy or better engagement of the threshold cap 104.

The threshold cap 104 may be made of plastic, aluminum, or other resilient material and generally has left and right descending walls 250, 252 and a top 254 that span the necessary or desired distance, generally from the second wall 134 and the first wall 132. In general, the threshold cap 104 encloses the main U-shaped channel 130 and the main threshold portion 114. The threshold cap 104 can travel vertically with respect to the frame member 106 and the main channel 130 as set forth in more detail below. It is generally limited in the degrees of freedom of its travel in a manner similar to that of the H-rail 120 as described above with respect to vertical travel and travel into and out of the plane of the page as shown in FIG. 1.

The left descending wall 250 of the threshold cap 104 descends generally into the gap between the upward inward projection of the lip 194 and the inward projection 136. The descent of the left descending wall 250 is limited by the bottom of the inward projection 136 as shown in FIG. 1 and generally in the lower-most position of the threshold cap 104. An inward projection or stub 260 generally entraps the outward projection of the left T-head 238 of the H-rail 120 between the inward projection 260 and the top 254 of the threshold cap 104. A corresponding projection 262 may serve to entrap the outward T projection of the right T-head 240 of the right leg 234 between the inward projection 262 and the threshold cap top 254. In this way, the threshold top 104 is coupled to the H-rail 120 and vice versa. Consequently, travel or positioning of the H-rail serves to control the travel and positioning of the threshold top 104.

The right descending wall 252 of the threshold cap 104 may generally frictionally, snugly and slidably engage the exterior of the first wall 132 of the frame member 106. The bead or seam 160 may enable visual and or tactile confirmation of the generally safe extent of vertical travel of the threshold cap 104 with respect to the frame member 106. The right descending wall 252 may terminate in an edge tip 270 which may flex when the outwardly projecting bead 160 engages it.

Conversely, the left descending wall 250 may be thicker in nature so as to provide stability and resilience as the left descending wall 250 may generally engage (and be somewhat laterally entrapped by) both the upward and inward projection 194 of the lip 122 as well as the outwardly extending projection of the inward projection 136. This engagement of the left descending wall may serve to stabilize it by the entrapment between these two projections 136, 194.

The threshold cap 104 may have plugs (not shown) enabling access to the adjustment screw 210. When the adjustment screw 210 is threaded into the threaded aperture 202, it exerts a downward force on the adjustment screw channel 166 and a corresponding upward force on the H-rail 120. Threading the adjustment screw 210 into the threaded aperture 202 raises the H-rail 120 and vice versa. Upon achieving a desired height, the remaining adjustment screws (not shown) may be threaded into their threaded apertures 202 to the proper height. The plugs (not shown) of the threshold cap 104 may then be placed back into their apertures thereby generally sealing the threshold cap 104. The adjustable threshold 100 is then ready for use as its height has been achieved and secured. While the adjustment screws 210 generally do not move during normal use, locking nuts or the like can also be used in order to secure the adjustment screws 210 in their place and position.

The lip 122 and vinyl insert 124 serve to help mediate the transition between the floor F and the adjustable threshold 100, and may serve to provide means by which the associated door may be engaged by the adjustable threshold 100. The vinyl insert 124 may keep out dirt, dust, and the like between the seam present between the floor F and the second wall 134 of the frame member 106.

Generally, assembly of the adjustable threshold 100 occurs with the insertion of the adjustment screws 210 into their threaded apertures 202. The threshold cap 104 can then be slid upon the H-rail 120 with its two side walls 226, 228 with their T-heads 238, 240. The H-rail assembly may then be positioned into the main U-shaped channel 130 between the two abutting members 140, 136. By a snap fit or other sliding maneuver, the H-rail 120 with the threshold cap 140 is then pressed into the main U-shaped channel 130 and adjustment of the H-rail 120 and threshold cap 104 may begin and be quickly effected.

Figure 2:
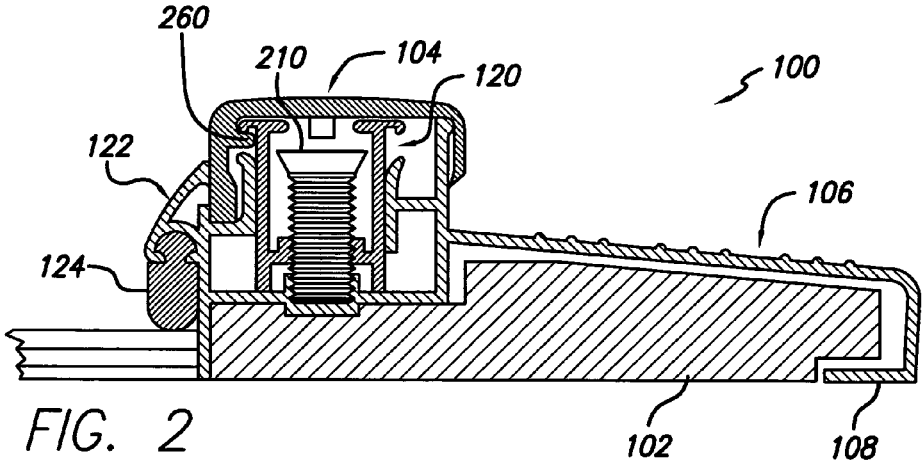
FIG. 2 is a side cross-section view of an alternative embodiment of the adjustable threshold of FIG. 1.
Figure 3:
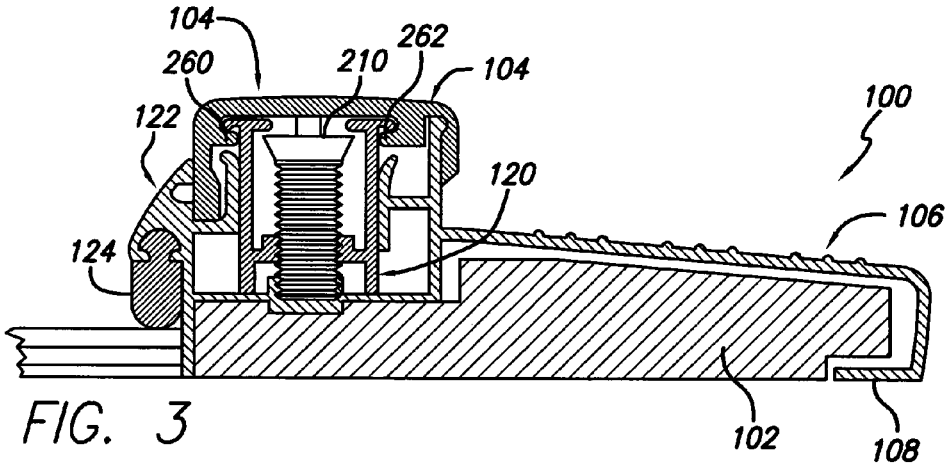
FIG. 3 is a side cross-sectional view of an alternative embodiment of the adjustable threshold of FIG. 1.
Figure 4:
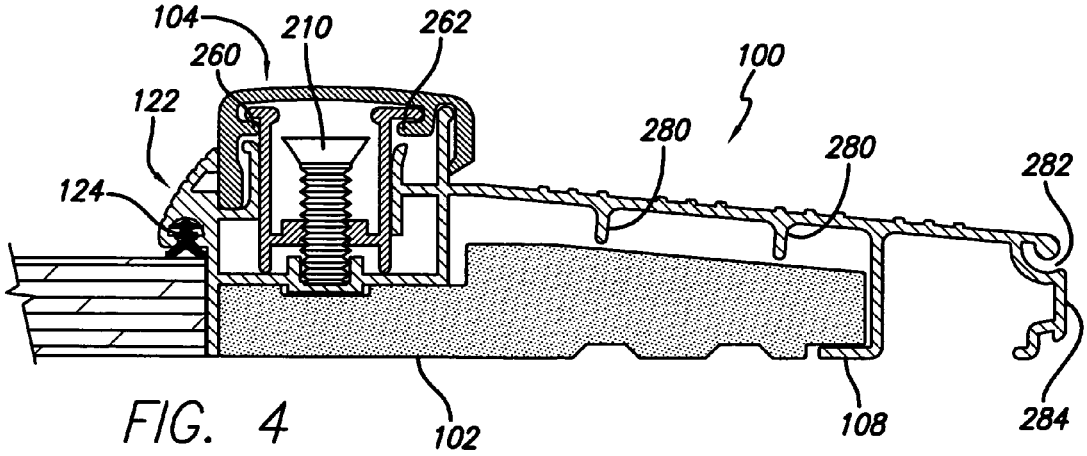
FIG. 4 is a side cross-sectional view of an alternative embodiment of the adjustable threshold shown in FIG. 1.

FIGS. 2-4 show alternative embodiments of the embodiment shown in FIG. 1. Note should be taken in FIG. 1 that a space 292 exists between the right inward projection 262 of the threshold cap 104 and the top of the first wall 132 with its bead or seam 160. In this embodiment, the right inward projection 262 does not come into contact with the first wall 132.

In FIG. 2, the right inward projection 262 is omitted entirely, leaving it to the right descending wall 252 and the left descending wall 250 with the left inward projection 260 to hold the threshold cap 104 in place upon the main U-shaped channel 130.

In FIG. 3, the right inward projection 262 is in contact with the first wall 132 near its top.

In FIG. 4, the right inward projection 262 is in contact with the first wall 132 and the frame member 106 enjoys some separation from the substrate block 102 due to descending ribs or walls 280 present below the sloped sill portion 110 of the frame member 106. A front projection 282 provides additional sloped sill portion 110 with channels grooves and/or apertures that may be present for the slidable or other insertion or engagement of additional plastic or other members at the front end 284 of the frame member 106. Note should be taken, that a shelf 108 is still present in the embodiment shown in FIG. 4 that engages a cut-out or notched front end of the substrate block 102.

In some embodiments, the adjustable threshold 100 of the present system may have a minimum height of one and three-eighths inches (1⅜"). The embodiment shown in FIG. 3 may have an overall length of approximately three and three-quarter inches (3¾") while an embodiment such as that shown in FIG. 4 may have an overall length of four and five-sixteenths inches (4⁵⁄₁₆").

Figure 5:
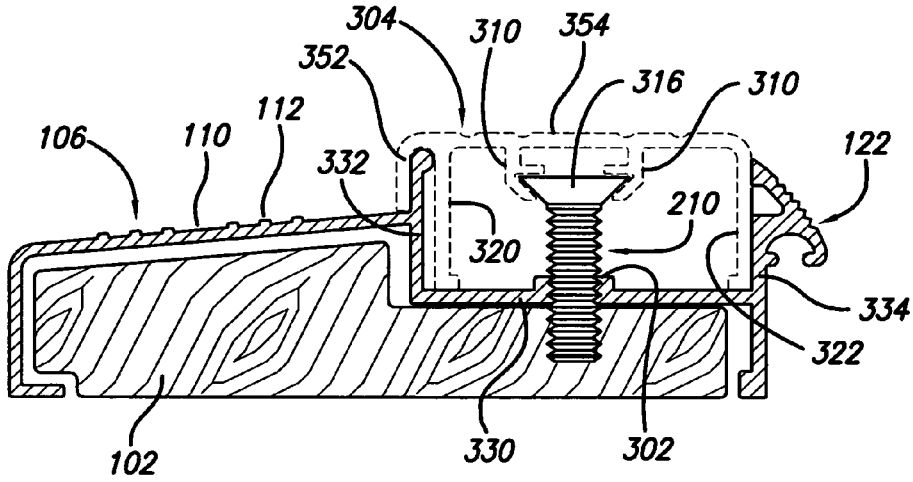
FIG. 5 is a side cross-sectional view of an alternative embodiment of the adjustable threshold without an H-shaped rail and with a threshold cap engaging the adjustment screw.
Figure 6:
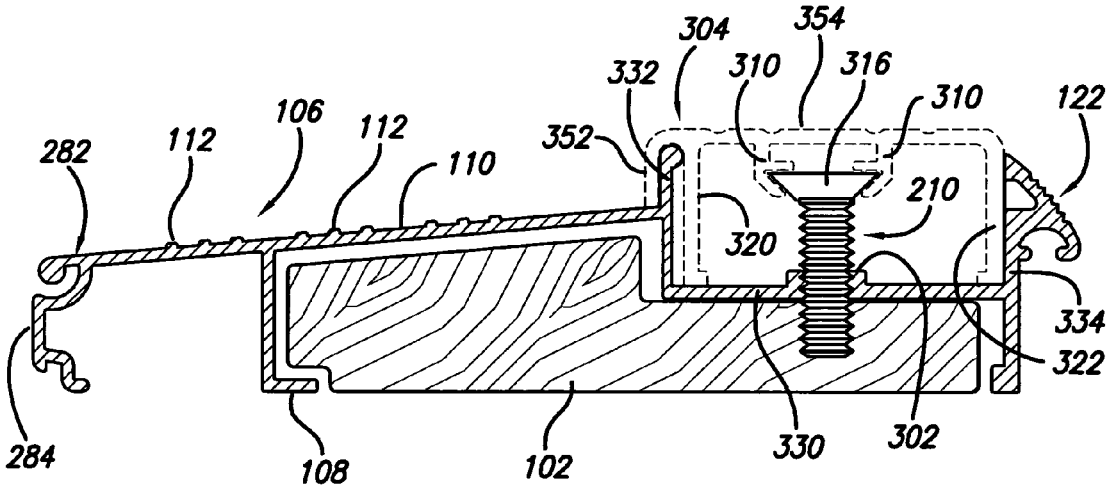
FIG. 6 is a side cross-sectional view of an alternative embodiment of the adjustable threshold shown in FIG. 5 having a front projection.

FIGS. 5 and 6 show an additional alternative embodiment of the present invention, both of which omit the H-shaped rail 120. Instead, the adjustment screw 210 provides an adjustment member and is directly coupled by sliding attachment to the threshold cap 304.

In the embodiment shown in FIGS. 5 and 6, the adjustment screw 210 is threadably attached to a modified U-shaped channel 330. The adjustment screw or bolt 210 slidably engages the threshold cap 304 adjacent its top 354 via descending arms 310 or an otherwise circular (or partially circular) aperture into which the head 316 may be engaged by the arms or circular aperture 310. If a pair of descending arms 310 is used to gage the head 316 the adjustment screw 210, such arms 310 may be some what curved or partially circular in nature to better engage the screw head 316.

The front alignment wall 320 may work in conjunction with a front descending wall 352 to entrap the front wall 332 of the modified U-shaped channel 330. The rear wall 334 of the modified U-shaped channel 330 serves to guide and restrain a rear descending wall 322 of the threshold cap 304.

As can be seen from the drawings, rotation of the adjustment screw 210 causes such a thread around thread from the threaded aperture 302. This in turn causes the threshold cap 304 to raise or lower according to the threaded disposition of the adjustment screw 210. In this way, the threshold cap 304 may be vertically adjusted. A cosmetic cap snuggly insertable into an aperture over the head 316 of the adjustment screw 210 (the cosmetic cap not shown) serves to enable access to the slotted or otherwise engageable head 316 of the adjustment screw 210.

FIG. 6 is similar to FIG. 5, with the main difference being that the embodiment shown in FIG. 6 has a front projection 282 with a front 284 in a manner similar to that shown in FIG. 4. FIGS. 5 and 6 additionally show the presence of a lip 122 in a variety of adjustable threshold configurations and embodiments.

While the present invention has been described with regards to particular embodiments, it is recognized that additional variations of the present invention may be devised without departing from the inventive concept.

What is claimed is:

1. An adjustable threshold for use in conjunction with a doorway, the adjustable threshold comprising:

a frame member having a main U-shaped channel and a sloped sill portion;

said U-shaped channel including a first abutment member coupled to said first wall and a second abutment member coupled to said second wall, said first and second abutment members abutting opposite sides of said adjustment member;

an adjustment member engaging said frame member said first abutment member having a first inwardly projecting strip support coupled to a T-shaped head, an upper projection of said T-shaped head projecting away from said adjustment member;

said second abutment member having a second inwardly projecting strip support similar to said first inwardly projecting strip support coupled to an upwardly-extending projection having a distal end thereof projecting away from said adjustment member;

said adjustment member slidably entrapped between said first and second abutment members;

a lip coupled to said main U-shaped channel; and a threshold cap engaging said main U-shaped channel, said adjustment member, and said lip; whereby adjustment of said adjustment member adjusts height of said threshold cap with respect to said frame member.

2. An adjustable threshold for use in conjunction with a doorway as set forth in claim 1, wherein said lip further comprises:

a downward projection defining an open inlet between said downward projection and said frame member; and an inwardly and upwardly projecting member coupled to said downward projection and projecting towards said frame member.

3. An adjustable threshold for use in conjunction with a doorway as set forth in claim 2, wherein said lip further comprises:

a vinyl insert at least partially inserted into said open inlet, said vinyl insert capable of covering an underlying material including flooring material to provide a seamless appearance between said underlying material and the adjustable threshold.

4. An adjustable threshold for use in conjunction with a doorway as set forth in claim 1, wherein said sloped sill portion further comprises:

a rib.

5. An adjustable threshold for use in conjunction with a doorway as set forth in claim 4, wherein said rib is selected from the group consisting of upwardly extending ribs for improved traction and downwardly extending support ribs.

6. An adjustable threshold for use in conjunction with a doorway as set forth in claim 1, wherein said frame member further comprises:

a shelf coupled to said sloped sill portion, said shelf providing a front support for said frame member.

7. An adjustable threshold for use in conjunction with a doorway as set forth in claim 1, wherein said frame member further comprises:

a first wall coupled to said sloped sill portion and providing a first side of said main U-shaped channel;

a bottom coupled to said first wall and providing a bottom to said main U-shaped channel; and a second wall coupled to said bottom and providing a second side of said main U-shaped channel.

8. An adjustable threshold for use in conjunction with a doorway as set forth in claim 7, wherein said bottom further comprises:

said bottom defining a threaded aperture for receiving said adjustment member.

9. An adjustable threshold for use in conjunction with a doorway as set forth in claim 8, further comprising:

said threaded aperture providing adjustment screw receptacle; and an adjustment screw channel defined in said frame member.

10. An adjustable threshold for use in conjunction with a doorway as set forth in claim 1, wherein said adjustment member comprises a vertically adjustable rail.

11. An adjustable threshold for use in conjunction with a doorway as set forth in claim 10, wherein said vertically adjustable rail further comprises:

an H-shaped rail.

12. An adjustable threshold for use in conjunction with a doorway as set forth in claim 11, wherein said H-shaped rail further comprises:

a left side wall;

a right side wall;

a cross member coupled on one side to said left side wall and on another side to said right side wall, said cross member defining a threaded aperture for receiving a threaded member.

13. An adjustable threshold for use in conjunction with a doorway as set forth in claim 12, wherein said threaded member is selected from the group consisting of screws and bolts.

14. An adjustable threshold for use in conjunction with a doorway as set forth in claim 12, wherein said left side wall has an upward projection terminating in an outward projection for engaging said threshold cap.

15. An adjustable threshold for use in conjunction with a doorway as set forth in claim 12, wherein said right side wall has an upward projection terminating in an outward projection for engaging said threshold cap.

16. An adjustable threshold for use in conjunction with a doorway as set forth in claim 1, wherein said threshold cap further comprises:

a left descending wall;

a top coupled to said left descending wall; and a right descending wall coupled to said top.

17. An adjustable threshold for use in conjunction with a doorway as set forth in claim 16, wherein said left descending wall engages said frame member and said lip.

18. An adjustable threshold for use in conjunction with a doorway as set forth in claim 16, wherein said right descending wall engages a side of said U-shaped channel.

19. An adjustable threshold for use in conjunction with a doorway as set forth in claim 16, wherein said top defines an aperture for receiving a plug.

20. An adjustable threshold for use in conjunction with a doorway as set forth in claim 1, further comprising:

a substrate block, said frame member at least partially covering said substrate block.

21. An adjustable threshold for use in conjunction with a doorway as set forth in claim 1, further comprising:

said adjustment member comprising a threaded member having a head;

said threaded member threadedly engaging said frame member; and said threshold cap slidably engaging said head; whereby said threaded member may be threaded into and out of said frame member to vertically dispose said threshold cap with respect to said frame member.

22. An adjustable threshold for use in conjunction with a doorway, the adjustable threshold comprising:

a substrate block;

a frame member covering at least a portion of said substrate block and having a main U-shaped channel;

said frame member including a sloped sill portion having a rib selected from the group consisting of upwardly extending ribs for improved traction and downwardly extending support ribs;

a vertically adjustable H-shaped rail slidably fitting within said main U-shaped channel, said H-shaped rail having a left side wall, a right side wall, and a cross member coupled on one side to said left side wall and on another side to said right side wall, said cross member defining a threaded aperture for receiving a threaded adjustment member, said threaded adjustment member selected from the group consisting of screws and bolts;

a shelf coupled to said sloped sill portion, said shelf providing a front support for said frame member;

said frame member having a first wall coupled to said sloped sill portion and providing a first side of said main U-shaped channel, having a bottom coupled to said first wall and providing a bottom to said main U-shaped channel, and having a second wall coupled to said bottom and providing a second side of said main U-shaped channel;

said U-shaped channel having a first abutment member coupled to said first wall, having a second abutment member coupled to said second wall, and having said first and second abutment members abutting opposite sides of said vertically adjustable rail;

said first abutment member having a first inwardly projecting strip support coupled to a T-shaped head, an upper projection of said T-shaped head projecting away from said vertically adjustable rail;

said second abutment member having a second inwardly projecting strip support similar to said first inwardly projecting strip support coupled to an upwardly-extending projection having a distal end thereof projecting away from said vertically adjustable rail such that said vertically adjustable rail is slidably entrapped between said first and second abutment members;

said bottom defining an adjustment member channel for receiving said threaded adjustment member;

a lip coupled to said main U-shaped channel, said lip having a vinyl insert capable of covering an underlying material including flooring material to provide a seamless appearance between said underlying material and the adjustable threshold;

a threshold cap engaging said main U-shaped channel and said lip such that adjustment of said threaded adjustment member adjusts height of said threshold cap, said threshold cap having a left descending wall, a top coupled to said left descending wall, and a right descending wall coupled to said top;

said left descending wall engaging said frame member and said lip;

said right descending wall engaging said external side of said U-shaped channel;

said top defining an aperture for receiving a plug;

said left side wall of said H-shaped rail having an upward projection terminating in an outward projection for engaging said threshold cap; and said right side wall of said H-shaped having an upward projection terminating in an outward projection for engaging said threshold cap.

23. An adjustable threshold for use in conjunction with a doorway, the adjustable threshold comprising:

a substrate block;

a frame member covering at least a portion of said substrate block and having a main U-shaped channel;

said frame member including a sloped sill portion having a rib selected from the group consisting of upwardly extending ribs for improved traction and downwardly extending support ribs;

an adjustment member comprising a threaded member having a head;

said threaded member threadedly engaging said frame member and selected from the group consisting of screws and bolts;

a shelf coupled to said sloped sill portion, said shelf providing a front support for said frame member;

said frame member having a first wall coupled to said sloped sill portion and providing a first side of said main U-shaped channel, having a bottom coupled to said first wall and providing a bottom to said main U-shaped channel, and having a second wall coupled to said bottom and providing a second side of said main U-shaped channel;

said U-shaped channel having a first abutment member coupled to said first wall, having a second abutment member coupled to said second wall, and having said first and second abutment members abutting opposite sides of said vertically adjustable rail;

said first abutment member having a first inwardly projecting strip support coupled to a I-shaped head, an upper projection of said T-shaped head projecting away from said vertically adjustable rail;

said second abutment member having a second inwardly projecting strip support similar to said first inwardly projecting strip support coupled to an upwardly-extending projection having a distal end thereof projecting away from said vertically adjustable rail such that said vertically adjustable rail is slidably entrapped between said first and second abutment members;

said bottom defining an adjustment member aperture for threadably receiving said adjustment member;

a lip coupled to said main U-shaped channel, said lip having a vinyl insert capable of covering an underlying material including flooring material to provide a seamless appearance between said underlying material and the adjustable threshold;

a threshold cap engaging said main U-shaped channel and said lip, said threshold cap having a left descending wall, a top coupled to said left descending wall, and a right descending wall coupled to said top;

said left descending wall engaging said frame member and said lip;

said right descending wall engaging an internal side of said U-shaped channel;

said top defining an aperture for receiving a plug;

said threshold cap slidably engaging said head of said adjustment member; whereby said threaded member may be threaded into and out of said frame member to vertically dispose said threshold cap with respect to said frame member.

* * * * *